US010308998B2

(12) United States Patent
Franklin et al.

(10) Patent No.: US 10,308,998 B2
(45) Date of Patent: Jun. 4, 2019

(54) 7XXX ALLOY DEFENCE APPLICATIONS WITH A BALANCED ARMOR PIERCING FRAGMENTATION PERFORMANCE

(71) Applicants: CONSTELLIUM ROLLED PRODUCTS RAVENSWOOD, LLC, Ravenswood, WV (US); CONSTELLIUM VALAIS SA, Sierre (CH)

(72) Inventors: Jack Franklin, Plymouth, MA (US); Christophe Jaquerod, Noes (CH); Michael Niedzinski, South Barrington, IL (US)

(73) Assignees: CONSTELLIUM ROLLED PRODUCTS RAVENSWOOD, LLC, Ravenswood, WV (US); CONSTELLIUM VALAIS SA, Sierre (CH)

( * ) Notice: Subject to any disclaimer, the term of this patent is extended or adjusted under 35 U.S.C. 154(b) by 277 days.

(21) Appl. No.: 15/123,421

(22) PCT Filed: Mar. 3, 2015

(86) PCT No.: PCT/EP2015/000471
§ 371 (c)(1),
(2) Date: Sep. 2, 2016

(87) PCT Pub. No.: WO2015/131992
PCT Pub. Date: Sep. 11, 2015

(65) Prior Publication Data

US 2017/0218487 A1 Aug. 3, 2017

Related U.S. Application Data

(60) Provisional application No. 61/948,870, filed on Mar. 6, 2014.

(51) Int. Cl.
*C22C 21/10* (2006.01)
*C22F 1/053* (2006.01)
*F41H 5/02* (2006.01)

(52) U.S. Cl.
CPC ..... *C22C 21/10* (2013.01); *C22F 1/053* (2013.01); *F41H 5/02* (2013.01)

(58) Field of Classification Search
None
See application file for complete search history.

(56) References Cited

U.S. PATENT DOCUMENTS 6,972,110 B2 * 12/2005 Chakrabarti ..... B22D 17/2209 148/417
8,206,517 B1 6/2012 Bush et al.
2006/0174980 A1 8/2006 Benedictus et al.

FOREIGN PATENT DOCUMENTS

EP 0829552 A1 3/1998
WO 2006037648 A1 4/2006

OTHER PUBLICATIONS

International Search Report dated May 15 2015, issued in counterpart International Application No. PCT/EP2015/000471.

(Continued)

*Primary Examiner* — Deborah Yee
(74) *Attorney, Agent, or Firm* — McBee Moore Woodward & Vanik IP, LLC; Susan E. Shaw McBee; David Vanik

(57) ABSTRACT

An armor component produced from a 7xxx series aluminum alloy, wherein the aluminum alloy consists essentially of:

Figure 1A:
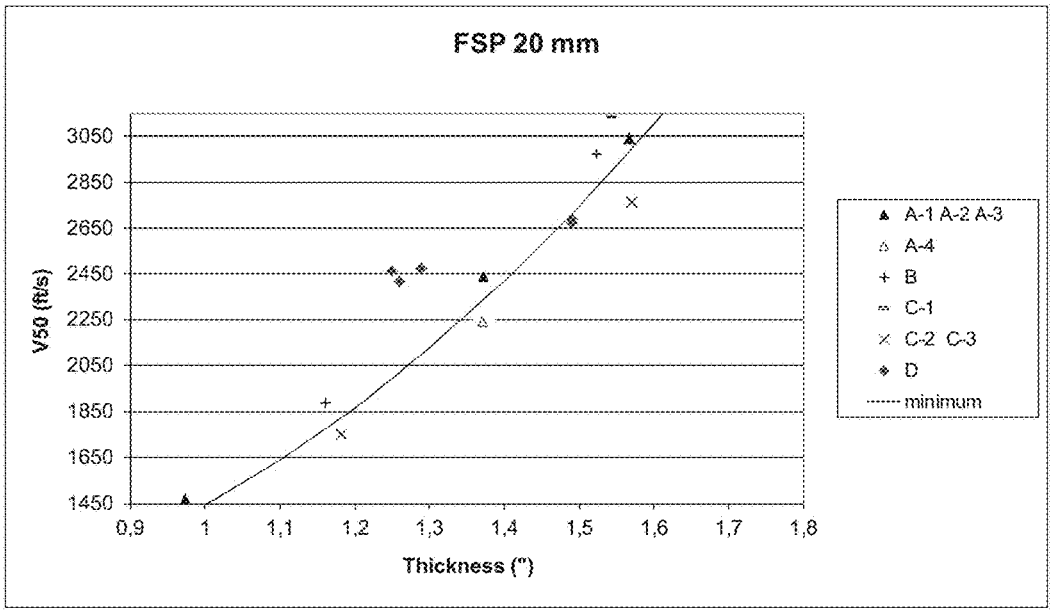

8.4 wt. %≤Zn≤10.5 wt. %; 1.3 wt. %≤Mg≤2 wt. %; 1.2 wt. %≤Cu≤2 wt. %;

at least one dispersoid forming element with a total dispersoid forming element content higher than 0.05 wt. %;

(Continued)

the remainder substantially aluminum, incidental elements and impurities.

20 Claims, 1 Drawing Sheet

(56) References Cited

OTHER PUBLICATIONS

Mondal et al., "Effect of heat treatment on the behavior of an AA7055 aluminum alloy during ballistic impact" International Journal of Impact Engineering. (2011) vol. 38: 745-754.

* cited by examiner

7XXX ALLOY DEFENCE APPLICATIONS WITH A BALANCED ARMOR PIERCING FRAGMENTATION PERFORMANCE

CROSS REFERENCE TO RELATED APPLICATIONS

This application is a § 371 National Stage Application of PCT/EP2015/000471, filed Mar. 3, 2015, which claims priority provisional application No. 61/948,870, filed Mar. 6, 2014.

BACKGROUND

Field of the Invention

The present disclosure relates to armor components for military vehicles made of high strength aluminum alloys, such as 7xxx series aluminum alloys. It relates more particularly to armor components used for manufacturing armor hull walls and add-on appliqués, which are removable panels to be mounted on the external faces of the vehicles.

Description of Related Art

Generally, an armor shield includes a metal panel, typically of steel, aluminum, titanium or alloys thereof. Such panels generally have an excellent ability to absorb kinetic energy of a penetrator during impact. However, particularly if they are made of a steel alloy, such panels are heavy and have a low effectiveness in terms of absorption of energy when related to the weight carried by a vehicle. Therefore aluminum components made of aluminum alloys are preferred for such applications.

The armor panel has a face exposed to impacts and shocks and a rear or exit face. Upon impact on a metallic armor panel, the armor-piercing projectile can be completely stopped in the panel but the damage to the panel on its rear face can result in the formation of fragments which are violently ejected from the panel towards the vehicle interior.

Unless otherwise indicated, all the indications relating to the chemical composition of the alloys are expressed as a mass percentage by weight based on the total weight of the alloy. The expression 1.4 Cu means that the copper content in weight % is multiplied by 1.4. Alloy designation is in accordance with the regulations of The Aluminium Association, known of those skilled in the art. The definitions of tempers are laid down in European standard EN 515.

Unless mentioned otherwise, static mechanical characteristics, in other words the ultimate tensile strength UTS, the tensile yield stress TYS and the elongation at fracture A, are determined by a tensile test according to standard EN 10002-1, the location at which the pieces are taken and their direction being defined in standard EN 485-1. Definitions according to EN 12258-1 apply unless mentioned otherwise.

To characterize their shield effectiveness, armor panels are generally subjected to two types of tests. The first test, intended to quantify their ability to stop the piercing projectiles, is designated by the letters "AP" ("Armor Piercing") and characterizes the resistance to perforation. The second test is intended to quantify their ability to withstand the impacts which generate fragmented debris. This second type of test is referred to by the abbreviation "FSP" ("Fragment simulated projectiles"). During these tests, the armor panels are the target of projectiles of different shapes and sizes (spindle shape for the AP test, a more squat form for the FSP test). In each test type, several geometries are used in the projectile according to the thickness of the test panel and the nature of the threats that said armor panel is intended to protect. For example, according to U.S. military specification MIL-DTL-46063H, plates made of 7039 alloy and thicker than 1.5" are submitted to AP tests with 0.5" caliber AP M2 bullets while plates thinner than 1.5" are submitted to AP tests with 0.3" caliber AP M2 bullets. However, in practice, 0.3" caliber AP M2 bullets are still used for AP tests on plates slightly thicker than 1.5".

For both tests, the ability to stop bullets and absorb their kinetic energy is quantified by a parameter called "V50 ballistic limit" having a speed dimension. V50 is defined for example in MIL-STD-662 (1997) standard: it is the velocity at which the probability of penetration of an armor material is 50%. It is established by calculating the average of speeds attained by the projectiles on impact resulting from taking the same number of results having the highest speeds corresponding to a partial penetration and results having the lowest speeds corresponding to a complete penetration. A complete penetration occurs when the impacting projectile or any fragment (of the projectile or of the test specimen) perforates a thin witness plate located behind the test specimen.

For all armor materials, Armor Piercing resistance and Fragment Simulated Particles resistance are antagonist properties: when a material has a high AP resistance, it often has a poor FSP resistance. Conversely, a material with high FSP resistance often has an ordinary AP resistance.

U.S. Pat. No. 8,206,517 discloses an armor component in the form of a plate having a thickness of 1-4 inches made of a 7xxx series aluminum alloy, which contains essentially 7.0-9.5 wt. % Zn, 1.3-1.68 wt. % Mg, 1.2-1.9 wt. % Cu, up to 0.4 wt. % of at least one grain structure element, the rest being aluminum and incidental elements and impurities. Said 7xxx series aluminum alloy is overaged such that it should comply simultaneously with three conditions relating to yield strength, FSP performance and spall resistance. The chemistry of the 7xxx-series aluminum alloy claimed by U.S. Pat. No. 8,206,517 largely overlaps with that of alloy AA7085. U.S. military specification MIL-DTL-32375 (MR) covers 7085 wrought aluminum alloy armor plate for non-fusion welded applications in nominal thicknesses from 0.500 to 3.000 inch. According to this specification, 7085 alloy should only be used as unweldable appliqué armor.

It is generally difficult to achieve 7XXX alloys that have simultaneously high armor piercing resistance (AP) and fragment simulated particle (FSP) resistance. It is still more difficult to achieve 7XXX alloys that have also an acceptable behaviour after welding and may consequently be also used for manufacturing welded armor hull walls.

SUMMARY

A first object of the invention is an armor component produced from a 7xxx series aluminum alloy, wherein the aluminum alloy consists essentially of:

- 8.4 wt. %≤Zn≤10.5 wt. %;
- 1.3 wt. %≤Mg≤2 wt. %;
- 1.2 wt. %≤Cu≤2 wt. %;
- at least one dispersoid forming element with a total dispersoid forming element content higher than 0.05 wt. %;
- the remainder substantially aluminum, incidental elements and impurities;

wherein the 7XXX alloy is in the form of a plate having a thickness of about 0.5 to about 3 inches, i.e. about 12.7 to about 76.2 mm;

wherein the 7XXX alloy is over-aged to achieve:

(i) a fragment simulated particles V50 ballistic limit such that:

$$V50(\text{FSP20 mm})>1633T^2-1479T+1290$$

where T is the thickness plate (unit: inch) and the unit of V50 is feet/s.

(ii) an armor piercing V50 ballistic limit such that:

$$V50(0.30\text{ cal AP }M2)>-282T^2+1850T+610$$

where T is the thickness plate (unit: inch) and the unit of V50 is feet/s.

DETAILED DESCRIPTION OF A PREFERRED EMBODIMENT

Zinc, magnesium and copper are the major alloying elements of the aluminium alloy of the armor component according to the invention. In comparison with aluminium alloy AA7039, which was developed more than 50 years ago for armor applications, said aluminium alloy comprises copper and has higher Zn content and lower Mg content.

Zinc is the first major alloying element. Combined with Mg and Cu content ranges defined in the frame of the present invention, the highest results obtained simultaneously in AP and FSP ballistics tests, i.e. on samples made from the same cast alloy, were obtained with a Zn content higher or equal to about 8.4 wt. % and lower or equal to about 10.5 wt. %. Preferably, Zn content is from about 8.5 wt. % and about 9.5 wt. %, more preferably from about 8.5% wt. and about 9.0 wt. %.

Magnesium has a content significantly lower than zinc content. Advantageously, Mg/Zn ratio is lower or equal to 0.20, where Mg and Zn are weight percentages of magnesium and zinc in the aluminium alloy. Combined with Zn and Cu content ranges defined in the frame of the present invention, the highest results obtained simultaneously in AP and FSP ballistics tests were obtained with a magnesium content lower than about 1.3 wt. % and higher than about 2%. Preferably, magnesium content is from about 1.5 wt. % and about 2 wt. %, more preferably from about 1.8 wt. % and about 2.0 wt. %, i.e. from about 1.75 wt. % and about 2.04 wt. %.

In contrast with AA7039, copper is a further major alloying element. Combined with Zn and Mg content ranges defined in the frame of the present invention, the highest results obtained simultaneously in AP and FSP ballistics tests were obtained with a copper content higher or equal to about 1.2 wt. % and lower or equal to about 2 wt. %. Preferably, Cu content is from about 1.4 wt. % and about 1.8 wt. %. The applicant noted also that simultaneously highest armor piercing resistance (AP) and fragment simulated particle (FSP) resistance values were obtained when copper and magnesium contents (in wt. %) were approximately the same, typically when $0.9 \leq Cu/Mg \leq 1.1$.

Dispersoid forming elements such as Zr, Sc, V, Hf, Ti, Cr and Mn are added to control the grain structure. The optimum levels of dispersoid forming elements depend on the processing. Preferably, the dispersoid forming element is essentially zirconium. Preferably, Zr content is less than about 0.15 wt. %, more preferably less than about 0.08 wt. %.

Another dispersoid forming element can be added, alone or with other dispersoid forming elements. For example, scandium may be added as dispersoid forming element. Its content is preferably lower than about 0.3 wt. %, and more preferably lower than about 0.18 wt. %. When combined with the zirconium, the sum of Sc and Zr is preferably less than about 0.17 wt. %. Chromium, hafnium or vanadium can be added with content lower than about 0.3 wt. %, preferably about 0.15 wt. %. Manganese can be added alone or in combination with one of the other dispersoid forming elements. A preferred maximum for the Mn addition is about 0.30 wt. %.

The remainder is substantially aluminum, incidental elements and impurities. "Substantially" will be understood to mean that small amounts of other elements may be intentionally added. "Incidental elements and impurities" will be understood to mean elements and impurity inclusions that are not intentionally added to the alloy, but which unavoidably occur in the alloy as a result of manufacturing processes or natural impurities in the individual alloy elements. Fe content is preferably lower than about 0.3 wt. %, more preferably lower than about 0.1 wt. %. Si content is preferably lower than about 0.2 wt. %, more preferably lower than about 0.1 wt. %. Preferably, each other impurity element is present at up to about about 0.05 wt. %, with total impurities content being up to about 0.15 wt. %, based upon the total weight of the alloy taken as 100 wt. %.

The alloy product according to the invention can be prepared by a conventional melting process and may be cast into ingot form. Grain refiners such as titanium boride or titanium carbide may also be used. After scalping and homogenisation 460° C.-520° C. between 5-60 hours, the ingot is further hot worked, typically hot rolled in several steps, to obtain a plate with a thickness near the targeted gauge, which is between 0.5 and 3 inches. The product is then preferably solution heat treated 1-5 hours at 460-480° C. and quenched to a temperature lower than 95° C. The product can be further processed, for example by stretching, for example up to 2%, typically between 1 and 3%, and then aged to obtain the combined targeted ballistic properties:

$$V50(\text{FSP20 mm})>1633T^2-1479T+1290 \quad \text{(I)}$$

$$V50(0.30\text{ cal AP }M2)>-282T^2+1850T+610 \quad \text{(II)}$$

where T is the thickness plate (unit: inch) and the unit of V50 is feet/s.

If the units used are from International Unit System, the inequalities to be complied with are:

$$V50(\text{FSP20 mm})>0.7715T^2-17.75T+393 \quad \text{(I')}$$

$$V50(0.30\text{ cal AP }M2)>-0.1331T^2+22.22T+186 \quad \text{(II')}$$

where T is the thickness plate (unit: mm), comprised between 23 mm and 41 mm, and the unit of V50 is m/s.

According to the invention, the 7XXX alloy plate of the armor component has a thickness from about 0.5 and about 3 inches, i.e. about 12.7 to about 76.2 mm. However, ballistic AP and FSP inequalities to be satisfied relate to a narrower thickness range (0.9"-1.5"), because minimum FSP 20 mm and 0.3 cal AP M2 V50 values are required for such thicknesses by the U.S. military standards (see for example MIL-DTL-46063H and MIL-DTL-32375). For this reason, the sentence "the 7xxx alloy is over-aged to achieve . . . " followed by particular ballistics properties, which can only be measured when said 7xxx alloy is in the form of a plate having a thickness between 0.9" and 1.5", will be understood to mean that the time-temperature over-aging schedule defined on a 7xxx alloy in the form of a plate having a thickness in said range may also be applied to said 7xxx alloy in the form of plates having a thickness inside the claimed range, which is thinner than 0.9" or thicker than 1.5".

Whatever aging treatment performed on them, known alloys do not present such an advantageous performance balance: if the ageing treatment was suitable for obtaining high V50 (0.3 cal AP M2) values, satisfying inequality (II), FSP properties are poor, such that V50 (FSP 20 mm) does not comply with inequality (I). Similarly, if the ageing treatment was suitable for obtaining high V50 (FSP 20 mm) values, satisfying inequality (I), AP properties are poor, such that V50 (0.3 cal AP M2) does not comply with inequality (II).

Preferably, homogenisation is made at about 493-507° C. at about 20 hours, the ingot is further hot rolled with a first pass at a temperature near 440° C., the rolled product is then solution heat treated for about 2-4 hours at about 470-475° C., and then quenched by immersion in or spraying with cold water or fast cooling and then over-aged in at least two steps. A typical two-step over-aging treatment is about 4-8 hours at about 110° C.-130° C.+about 12-20 hours at about 140° C.-160° C. A preferred two-step over-aging treatment is about 5-7 hours at about 115-125° C.+about 14-18 hours at about 145° C.-155° C.

In another embodiment, the total equivalent time at 150° C. of aging treatment does not exceed 25 h, preferably it is from about 5 h and about 25 h, and more preferably from about 10 h and about 20 h. The equivalent time t(eq) at 150° C. is defined by the formula:

$$t(eq) = \frac{\int \exp(-15683/T)dt}{\exp(-15683/T_{ref})}$$

where T is the instantaneous temperature in Kelvin of treatment which evolves with the time t (in hours) and $T_{ref}$ is a reference temperature selected at 150° C. (423 K). t(eq) is expressed in hours. The constant value of 15683 K is derived from the diffusion activation energy for Mg, Q=130400 J/mol. The formula provided t(eq) takes into account the heating and cooling steps.

In a preferred embodiment of the invention, the alloy chemistry is:

8.5 wt. %≤Zn≤9.5 wt. %;
1.5 wt. %≤Mg≤2 wt. %,
1.4 wt. %≤Cu≤1.8 wt. %;
Fe<0.1 wt. %;
Si<0.1 wt. %;
0.05 wt. %≤Zr≤0.15 wt. %; balance aluminum and incidental elements and impurities.

In some embodiments, the chemistry and manufacturing process make it possible to achieve better V50 ballistics results. For example, FSP ballistics limit are such that:

$$V50(\text{FSP20 mm})>1633T^2-1479T+1320 \quad \text{(I-a)},$$

or even $$V50(\text{FSP20 mm})>1633T^2-1479T+1350 \quad \text{(I-b)},$$

while AP ballistics limit still complies with inequality (II).

In other embodiments, FSP ballistics limit are such that:

$$V50(0.30\text{ cal AP }M2)>-282T^2+1850T+700 \quad \text{(II-a)}$$

or even $V50(0.30\text{ cal AP }M2)>-282T^2+1850T+790$ (II-b)

while FSP ballistics limit still complies with inequality (I).

In a preferred embodiment, the 7xxx alloy chemistry is:

8.5 wt. %≤Zn≤9.0 wt. %;
1.8 wt. %≤Mg≤2 wt. %,
1.4 wt. %≤Cu≤1.8 wt. %;
Fe<0.1 wt. %;
Si<0.1 wt. %;
0.05 wt. %≤Zr≤0.15 wt. %; balance aluminum and incidental elements and impurities;
the 7XXX alloy is in the form of a plate having a thickness of 0.5-3 inches;
the 7XXX alloy is over-aged to achieve:
(i) a fragment simulated particles V50 ballistic limit such that:

$$V50(\text{FSP20 mm})>1633T^2-1479T+1350 \quad \text{(I-b)}$$

where T is the thickness plate (unit: inch) and the unit of V50 is feet/s.

(ii) an armor piercing V50 ballistic limit such that:

$$V50(0.30\text{ cal AP }M2)>-282T^2+1850T+790 \quad \text{(II-b)}$$

where T is the thickness plate (unit: inch) and the unit of V50 is feet/s.

Moreover, armor plates according to the invention can be welded to manufacture armor hulls. According to 5.9 of the Ground Combat Vehicle Welding Code 19207-12472301, tensile test specimen were machined to measure the post-weld strength of a butt weld, which was obtained by placing 0.5" plates edge to edge and welding them using MIG technology. The butt weld obtained by this way has an ultimate tensile strength higher than 41 ksi, which is at least equal to 45% of the tensile strength before welding. The inventors note that, thanks to an appropriate choice of the filler wire, the butt weld can have a tensile strength higher than 44 ksi and even higher than 47 ksi. In the latter case, the post-weld ultimate tensile strength is at least equal to 50% of the tensile strength before welding.

Figure 1B:
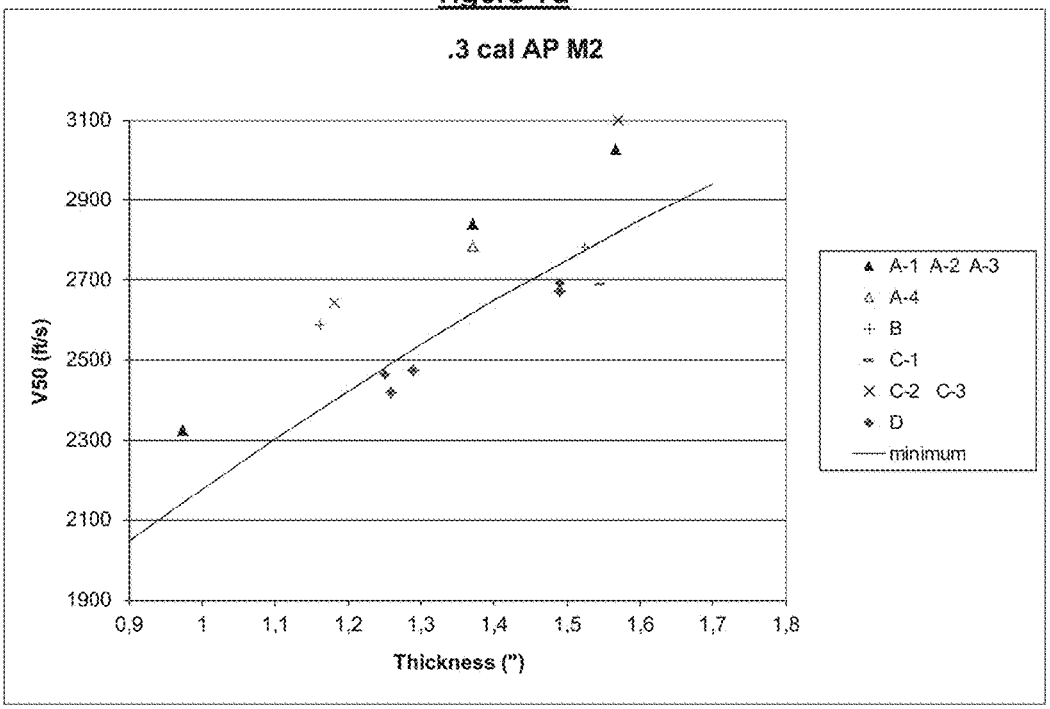

FIG. 1*a* and FIG. 1*b* are graphs illustrating respectively FSP ballistics performance and 0.3 cal AP M2 ballistics performance which may be obtained simultaneously with the armor plates according to the invention. Black line called "minimum" on FIG. 1*a* and FIG. 1*b* is respectively:

$$V50(\text{FSP20 mm})=1633T^2-1479T+1290, \text{ and}$$

$$V50(0.30\text{ cal AP }M2)=-282T^2+1850T+610)$$

where T is the thickness plate (unit: inch) and the unit of V50 is feet/s.

EXAMPLES

Example 1: AP and FSP Properties

Alloy plate products were made from alloys having the following chemical compositions, in weight percent:

TABLE 1

| Alloy | Zn | Mg | Cu | Fe | Si | Zr | Ti | Cr | Mn | Cu/Mg |
|---|---|---|---|---|---|---|---|---|---|---|
| A | 9.1 | 1.8 | 1.9 | 0.03 | 0.01 | 0.10 | 0.02 | — | 0.20* | 1.1 |
| B | 10.1 | 1.9 | 1.6 | 0.06 | 0.03 | 0.12 | 0.04 | — | 0.20* | 0.8 |
| C | 8.3 | 2.1 | 2.0 | 0.07 | 0.05 | — | 0.02 | 0.40* | 0.40* | 1.0 |
| D | 3.9 | 2.5 | 0.02 | 0.09 | 0.04 | 0.01 | 0.03 | 0.20* | 0.25* | 0.0 |

*nominal value

Alloys A and B have a chemistry according to the invention. Zinc content of alloy C is lower than the claimed minimum content. Ratio Mg/Zn of alloy C is approximately 0.25, i.e. higher than 0.20. Alloy D belongs to the AA7039-series aluminium alloys.

Plate products were made using the following process:

casting an ingot of an alloy whose composition is indicated in table 1;

homogenizing the ingot;

hot working the homogenized ingot to arrive at an intermediate gauge;

solution heat treating the plate;

quenching;

cold working said plate to arrive at a final gauge;

artificial aging the stretched plate as indicated in table 2.

Plate products had different thicknesses varying from 0.9" to 1.6" and were tested for their ballistic properties. Two ballistic tests have been carried out pursuant to U.S. military standard MIL-STD-662F (1997), namely the armor piercing test using 0.3 inch (7.62 mm) projectiles and the FSP test using 20 mm fragment simulating projectiles. The results, listed in Table 2, are illustrated in FIGS. 1.*a* and 1.*b*.

AA7039-series plate products, in particular the thinnest plates (D-3, D-4 and D-5), have quite good FSP ballistic properties while they have poor AP ballistics properties. Thicker plates D-1 and D-2 have both poor AP and FSP ballistics properties.

Results on C alloy plate products show that when FSP performance is high, AP performance is poor (C-1) and when AP performance is high, FSP performance is poor (C-2 and C-3).

Plate products A-1, A-2, A-3, B-1 and B-2 have combined high AP and FSP performances. Sample A-4 has the same thickness as A-1. It was more largely over-aged than A-1. AP ballistic performance of A-4 is a bit lower than A-1. FSP ballistic performance A-4 is more significantly lower than A-1.

TABLE 2

| Samples | Thickness (inches) | Temper | Equivalent time at 150° C.* | V50 (FSP 20 mm) ft/s | V50 (0.3 cal AP M2) ft/s |
|---|---|---|---|---|---|
| A-1 | 1.37 | 24 h@250° F. + 16 h@300° F. (24 h@121° C. + 16 h@149° C.) | 16.9 | 2439 | 2839 |
| A-2 | 1.57 | 24 h@250° F. + 16 h@300° F. (24 h@121° C. + 16 h@149° C.) | 16.9 | 3042 | 3026 |
| A-3 | 0.97 | 24 h@250° F. + 16 h@300° F. (24 h@121° C. + 16 h@149° C.) | 16.9 | 1471 | 2325 |
| A-4 | 1.37 | 24 h@250° F. + 35 h@300° F. (24 h@121° C. + 35 h@149° C.) | 34.3 | 2244 | 2785 |
| B-1 | 1.16 | 7 h@250° F. + 6 h@300° F. (7 h@121° C. + 6 h@149° C.) | 6.6 | 1890 | 2588 |
| B-2 | 1.52 | 7 h@250° F. + 12 h@350° F. (7 h@121° C. + 12 h@177° C.) | 118.8 | 2972 | 2781 |
| C-1 | 1.54 | 7 h@250° F. + 6 h@300° F. (7 h@121° C. + 6 h@149° C.) | 6.6 | 3128 | 2687 |
| C-2 | 1.18 | T7651 | | 1752 | 2641 |
| C-3 | 1.57 | T7651 | | 2763 | 3097 |
| D-1 | 1.49 | T6 | | 2747 | 2671 |
| D-2 | 1.49 | T6 | | 2751 | 2691 |
| D-3 | 1.25 | T6 | | 2057 | 2464 |
| D-4 | 1.26 | T6 | | 1977 | 2419 |
| D-5 | 1.29 | T6 | | 2082 | 2474 |

*heating rate 15° C./h

Example 2: Post Weld Strength

Couples of 0.5 inch thick plate products made of alloy A were butt welded along L direction. Other couples of 0.5 inch thick plate products made of alloy A were butt welded along LT direction. They were welded according to Ground Combat Vehicle Welding Code 19207, using MIG technology, a pulsed welding current and 1.2 mm or 1.6 mm diameter filler wires in AA5356 or in AA4043. Tensile test specimens were machined to measure the post-weld strength of these butt welds. Results of the tensile tests are shown in Table 3: in any case, the post-weld ultimate tensile strength is at least equal to 40.8 ksi (281 MPa), i.e. higher than 45% of the ultimate tensile strength before welding (607 MPA-88 ksi).

It can be noted that thanks to an appropriate choice of the filler wire, the butt weld has an ultimate tensile strength at least equal to 50% of the tensile strength before welding. It can be also noted that the butt weld has a tensile strength which is higher than 44 ksi (304 MPa), even higher than 47 ksi (324 MPa).

TABLE 3

| Base metal | | UTS MPa 607 | TYS MPa 590 |
|---|---|---|---|
| Filler wire: 4043 | Ø 1.2 | 283 | 222 |
| Filler wire: 4043 | Ø 1.6 | 281 | 229 |
| Filler wire: 5356 | Ø 1.2 | 291 | 232 |
| Filler wire: 5356 | Ø 1.6 | 326 | 246 |

The invention claimed is:

1. An armor component produced from a 7xxx series aluminum alloy, wherein the aluminum alloy consists essentially of:

8.4 wt. %≤Zn≤10.5 wt. %

1.75 wt. %≤Mg≤2 wt. %, 1.2 wt. %≤Cu≤2 wt. % at least one dispersoid forming element selected from the group consisting of Zr, Sc, V, Hf, Ti, Cr, and Mn, with a total dispersoid forming element content higher than 0.05 wt. %, wherein if the dispersoid forming element is Zr, the dispersoid forming element content is less than 0.15%, wherein if the dispersoid forming element is Sc, Cr, Hf, or V, the dispersoid forming element content is less than 0.3%, and wherein if the dispersoid forming element is Mn, the dispersoid forming element content is at most 0.3%;

the remainder substantially aluminum, incidental elements and impurities;

wherein the 7XXX alloy is in the form of a plate having a thickness of 0.5 to 3 inches;

wherein the 7XXX alloy is aged to achieve:

(i) a fragment simulated particles V50 ballistic limit such that $$V50(\text{FSP20 mm})>1633T^2-1479T+1290$$

where T is the thickness plate (unit: inch) and the unit of V50 is feet/s;

(ii) an armor piercing V50 ballistic limit such that:

$$V50(0.30\text{cal AP } M2)>-282T^2+1850T+610$$

where T is the thickness plate (unit: inch) and the unit of V50 is feet/s.

2. An armor component according to claim 1, wherein Mg/Zn≤0.20.

3. An armor component according to claim 1, wherein 0.9≤Cu/Mg≤1.1.

4. An armor component according to claim 1, wherein the dispersoid forming element is essentially zirconium, whose content is higher than 0.05 wt. % and less than 0.15 wt. %.

5. An armor component according to claim 1, wherein Fe<0.1 wt. % and Si<0.1 wt. %.

6. An armor component according to claim 1, wherein said 7xxx alloy in the form of a plate is manufactured by:

a) casting said alloy into ingot form;

b) homogenising said ingot;

c) hot working said ingot to obtain a plate;

d) solution heat treating;

e) quenching;

f) optionally stretching to obtain a plastic deformation from about 1 and about 3%;

g) aging corresponding to the following treatment: 4-8 hours at 110° C.-130° C.+12-20 hours at 140° C.-160° C.

7. An armor component according to claim 1, wherein said 7xxx alloy in the form of a plate is manufactured by:

a) casting said alloy into ingot form;

b) homogenising said ingot;

c) hot working said ingot to obtain a plate;

d) solution heat treating;

e) quenching;

f) optionally stretching to obtain a plastic deformation between 1 and 3%;

g) aging, a total equivalent time at 150° C. of aging treatment not exceeding 25 h.

8. An armor component according to claim 1, wherein the 7xxx series aluminum alloy consists essentially of:

8.5 wt. %≤Zn≤9.5 wt. %;

1.75 wt. %≤Mg≤2 wt. %, 1.4 wt. %≤Cu≤1.8 wt. %;

Fe<0.1 wt. %;

Si<0.1 wt. %;

0.05 wt. %≤Zr≤0.15 wt. %; balance aluminum and incidental elements and impurities.

9. An armor component according to claim 8, wherein 1.8 wt. %≤Mg≤2 wt. %.

10. An armor component according to claim 1, wherein FSP V50 ballistics limit is such that:

$$V50(\text{FSP20 mm})>1633T^2-1479T+1320 \quad \text{(I-a)}$$

where T is the thickness plate (unit: inch) and the unit of V50 is feet/s.

11. An armor component according to claim 1, wherein FSP V50 ballistics limit is such that:

$$V50(\text{FSP20 mm})>1633T^2-1479T+1350 \quad \text{(I-b)}$$

where T is the thickness plate (unit: inch) and the unit of V50 is feet/s.

12. An armor component according to claim 1, wherein AP V50 ballistics limit is such that:

$$V50(0.30\text{cal AP } M2)>-282T^2+1850T+700 \quad \text{(II-a)}$$

where T is the thickness plate (unit: inch) and the unit of V50 is feet/s.

13. An armor component according to claim 1, wherein AP V50 ballistics limit is such that:

$$V50(0.30\text{cal AP } M2)>-282T^2+1850T+790 \quad \text{(II-b)}$$

where T is the thickness plate (unit: inch) and the unit of V50 is feet/s.

14. An armor component according to claim 1, wherein said plate is fusion welded and wherein the post-weld ultimate tensile strength is greater than 45%, of the ultimate tensile strength before welding.

15. An armor component according to claim 1, wherein said plate is fusion welded and wherein the post-weld tensile strength is greater than 47 ksi.

16. A method of producing an armour component according to claim 1, comprising:

a) casting said alloy into ingot form;

b) homogenising said ingot;

c) hot working said ingot to obtain a plate;

d) solution heat treating;

e) quenching;

f) optionally stretching to obtain a plastic deformation from 1 and 3%;

g) aging corresponding to the following treatment: 4-8 hours at 110° C.-130° C.+12-20 hours at 140° C.-160° C.

17. A method of producing an armour component according to claim 1, comprising:

a) casting said alloy into ingot form;

b) homogenising said ingot;

c) hot working said ingot to obtain a plate;

d) solution heat treating;

e) quenching;

f) optionally stretching to obtain a plastic deformation between 1 and 3%;

g) aging, a total equivalent time at 150° C. of aging treatment not exceeding 25 h.

18. An armor component according to claim 1, wherein said plate is fusion welded and wherein the post-weld ultimate tensile strength is greater than 50% of the ultimate tensile strength before welding.

19. An armor component according to claim 1, wherein said plate is fusion welded and wherein the post-weld tensile strength is greater than 47 ksi.

20. An armor component according to claim 1, wherein the 7xxx series aluminum alloy consists essentially of:

8.5 wt. %≤Zn≤9.0 wt. %;

1.8 wt. %≤Mg≤2 wt. %, 1.4 wt. %≤Cu≤1.8 wt. %;

Fe<0.1 wt. %;

Si<0.1 wt. %;

0.05 wt. %<Zr<0.15 wt. %; balance aluminum and incidental elements and impurities;

wherein the 7XXX alloy is in the form of a plate having a thickness of about 0.5 to about 3 inches;

wherein the 7XXX alloy is aged to achieve:

(i) a fragment simulated particles V50 ballistic limit such that $$V50(\text{FSP20 mm})>1633T^2-1479T+1350$$

where T is the thickness plate (unit: inch) and the unit of V50 is feet/s;

(ii) an armor piercing V50 ballistic limit such that:

$$V50(0.30\text{cal AP } M2) > -282T^2 + 1850T + 790$$

where T is the thickness plate (unit: inch) and the unit of V50 is feet/s.

* * * * *